United States Patent [19]

Kildea

[11] Patent Number: 4,767,272

[45] Date of Patent: Aug. 30, 1988

[54] METHOD FOR REDUCING BLADE TIP VARIATION OF A BLADED ROTOR

[75] Inventor: Robert J. Kildea, North Palm Beach, Fla.

[73] Assignee: United Technologies Corporation, Hartford, Conn.

[21] Appl. No.: 108,181

[22] Filed: Oct. 14, 1987

[51] Int. Cl.[4] ..... F04D 29/66

[52] U.S. Cl. ..... 416/144; 416/500; 29/156.8 R

[58] Field of Search ..... 416/1, 61, 144, 223 A, 416/219 R, 219 A, 215, 248, 500, 204 A; 29/156.8 R, 156.8 P

[56] References Cited

U.S. PATENT DOCUMENTS

| | | | |
|---|---|---|---|
| 3,894,324 | 7/1975 | Holzapfel et al. | 29/156.8 R |
| 3,916,495 | 11/1975 | Klassen et al. | 29/156.8 R X |
| 3,974,700 | 8/1976 | Webb | 416/144 X |
| 4,602,412 | 7/1986 | Partington et al. | 29/156.8 R X |

FOREIGN PATENT DOCUMENTS

| | | | |
|---|---|---|---|
| 668679 | 10/1979 | U.S.S.R. | 416/500 |

*Primary Examiner*—Robert E. Garrett
*Assistant Examiner*—Joseph M. Pitko
*Attorney, Agent, or Firm*—Edward L. Kochey, Jr.

[57] ABSTRACT

A method of selecting particular blades to be placed in particular slots involving an initial selection based on length and a final dedication based on weight.

5 Claims, 2 Drawing Sheets

METHOD FOR REDUCING BLADE TIP VARIATION OF A BLADED ROTOR

The Government has rights in this invention pursuant to a contract awarded by the Department of the Army.

DESCRIPTION

1. Technical Field

The invention relates to bladed rotors for compressors or turbines and in particular to the selection of blades to be installed in particular blade slots.

2. Background of the Invention

Bladed turbine and compressor rotors rotate at high speed and therefore must be balanced to avoid distructive vibration. Each blade has a moment weight which is the product of the blade weight and the distance of the center of gravity from the Z plane. This Z plane represents the location at which the blade radial position in the rotor is established. It is known to arrange available blades in order of moment weight, and to match them at installation by placing blades of similar moment weight 180° apart on the rotor.

Tips of the rotor blades have a clearance from the surrounding surface within which the rotor rotates. Any excess clearance for any blade results in blade bypass and decreased performance. Since clearance must be based on the longest blade assembly, variation in length causes a parasitic performance loss. Tip grinding after assembly has been used to minimize this loss. Such grinding is at least difficult when using grited tip abrasion resistant blades, and also upsets the moment weights on which basis the blades were selected.

SUMMARY OF THE INVENTION

Blade selection for particular slots in a rotor is made by first obtaining slot and blade data, and based on this establishing a radial tolerance as a function of the rotor and blade radii. Candidate blades for each slot are determined preferentially within the radial tolerance and alternatively below the tolerance. After dedicating blades to a final slot location in unique cases a balance calculation is made. Dedication of blades to subsequent slots is made with selection from candidate blades at locations to compensate for unbalance.

A bladed rotor results having a minimum parasitic clearance as well as a low residual unbalance to be corrected.

DESCRIPTION OF THE PREFERRED EMBODIMENT

Figure 2:
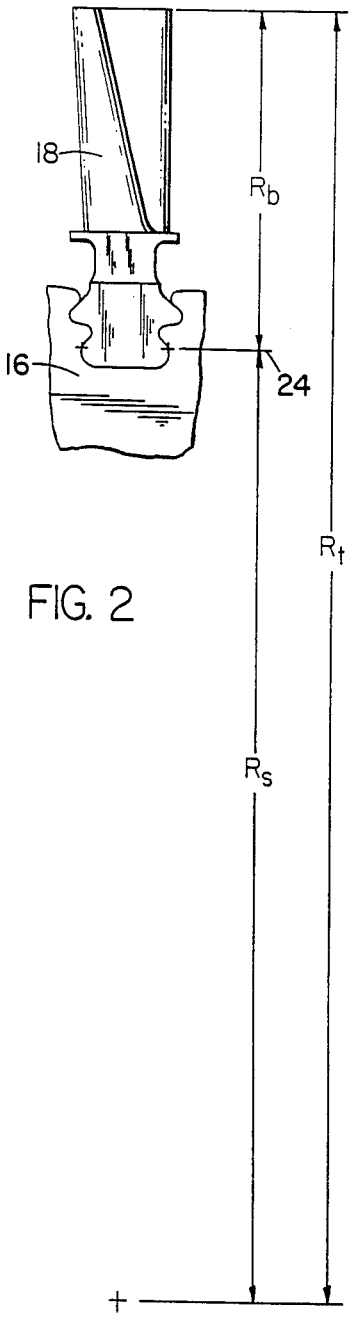
FIG. 2 is a detailed section through a rotor showing the rotor and blade dimensions.
Figure 1:
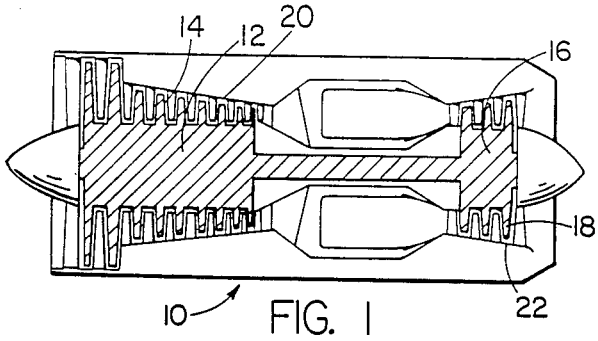
FIG. 1 is a general sectional view of a gas turbine engine.
Figure 3:
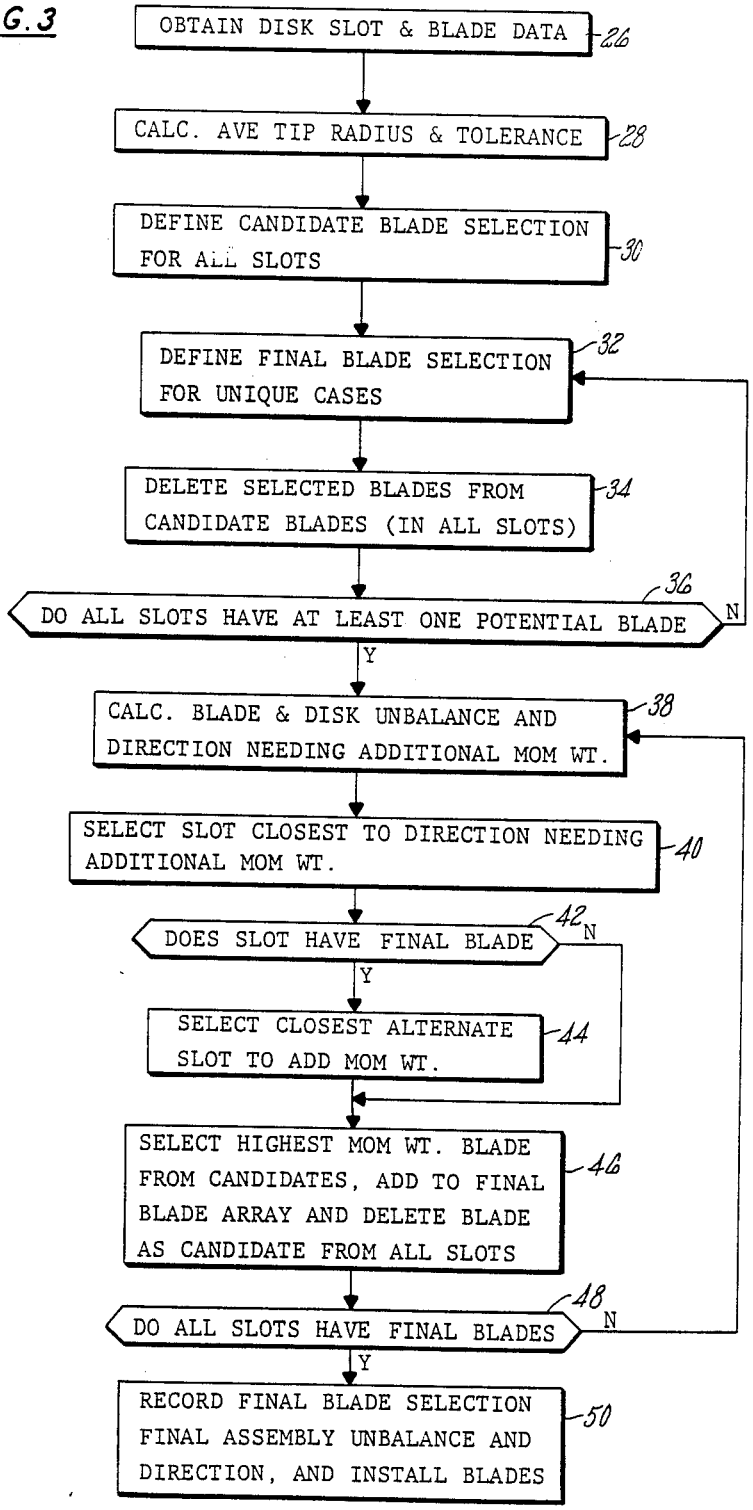
FIG. 3 is a logic diagram.

FIG. 1 is a general illustration of a gas turbine engine 10 having a compressor 12 carrying a plurality of compressor blades 14. Also illustrated is a gas turbine 16 carrying a plurality of gas turbine blades 18. In operation these blades rotate within the stator portions 20 and 22, respectively, thereby requiring a minimum clearance.

In starting the selection of blades to be placed within the blades of a rotor it is assumed that there is available a number of blades which at least equals the number of slots to be filled. The various slots and blades are identified for reference purposes. A Z plane 24 has been established by design. This plane being the point of interaction between any blade and the rotor which determines the radial location of the blade.

The number of slots (S) is known and the slot radius ($R_s$) is determined for each slot, this being the radius from the center of the disk to the Z plane 24.

The radius $R_b$ of each blade is determined, this not being a radius in the conventional sense but being the distance from the Z plane of the particular blade to its outer tip. The moment weight $B_m$ of each blade is also determined, this being the product of the weight of the blade times the distance of its center of gravity from the Z plane 24.

This step of obtaining disk slot and blade data is shown in instruction block 26 of the logic diagram.

As indicated by instruction block 28 the average tip radius and the radial tolerance is then established. The average tip radius ($R_a$) is equal to the average slot radius ($R_s$) and the average blade radius ($R_b$). The minimum tolerance (T) is equal to the maximum slot radius plus the minimum blade radius minus the sum of the minimum slot radius plus the maximum blade radius, all divided by two. The above tip radius is used in conjunction with this tolerance to establish a target total radial tolerance range equal to the average tip radius $R_a$ plus and minus the minimum tolerance (T). This establishes a maximum total radius ($R_t$).

The step in instruction box 30 involves determining the candidate blades which may be used within each slot and which will satisfy the tolerance requirement. Each slot accordingly will have one or more blades as candidate blades for the slot, such candidate blades being identified and placed in an array associated with the slot.

As in the step indicated in instruction box 32 the final blade selection is started. An array is established for retaining the selected blade data. Starting with the largest disk slot radius, and continuing with decreasing disk slot radii, unique blades are dedicated. If only one candidate blade exists for the slot, that blade is dedicated by being transferred to the final blade selection array and is deleted from possible candidates in all other slots. This is shown by instruction box 34. If no blade remains a candidate blade, the longest blade in the under tolerance side is selected and dedicated. If two or more blades meet the criteria, selection and dedication is deferred. This continues until all slots have either a final blade or a plurality of candidate blades as indicated by the query in inquiry block 36.

Should a situation occur where no dedicated candidate or under tolerance blade exist for a slot, the earlier selected tolerance may be incremented a selected discrete amount, such as 0.001 inches. The selection process is then restarted from instruction box 30.

With the initial selection of candidates or blades being made based on length, attention turns to the appropriate weight distribution for the remaining selection of blades. This will involve calculating the unbalance with various potential blades in place. Where the unbalance of the disk itself is already known this may be incorporated within the calculations. If not known, the underlying disk unbalance must be ignored.

The instruction in instruction box 38 starts the weight selection process. The blade and disk unbalance is calculated and the location of additional moment weight is determined. For this purpose the final selected blades are used for each slot where they have already been dedicated. In each of the other slots the lowest moment weight blade of the candidate blades for the slot is used. The same blade can be used in a plurality of slots for this calculation. The blade moment for each blade at this time is determined by the moment weight of the blade $B_m$ plus the difference between the actual slot radius and the average slot radius ($R_s - R_a$) multiplied by the weight of the blade. The average weight of all blades may be used in this calculation without any significant error. From this calculation the location of the need for increased moment weight is obtained.

As indicated by the step in instruction block 40 the closest slot to this location is determined. As indicated by the query in inquiry block 42 it is determined whether or not this closest slot has a final blade. If it does, then as indicated by instruction block 44 the closest available slot to that location is determined.

In either case the procedure of the step in box 46 is carried out wherein the highest moment weight blade is selected from the available candidates for the particular slot. This blade is then dedicated by adding it to the final blade array and deleting that blade as a candidate from all other slots. Since only one additional slot is filled at each time, the query in decision block 48 indicates the test as to whether all the slots are filled. If they have not been filled, the procedure is repeated from instruction block 38 until all slots have a final blade selected.

When all slots have been filled, the procedure passes to decision block 50 where the final blade selection is recorded and blades installed in the rotor. Should there have been excess blades at the beginning, the remaining blades are returned to storage for later use.

It may well be that additional conventional balancing is required on the disk assembly. However, the required balance is minimized by the particular selection among candidate blades, and variation in diameter with the concommitant parasitic losses is minimized.

I claim:

1. A method of selecting blade locations on a disk having slots receiving said blades with a Z plane establishing the radial positioning of each blade with respect to the disk, comprising:

(a) determining the Z plane radius ($R_s$) for each slot;

(b) determining the length ($R_b$) of each blade from its Z plane, and the moment weight ($B_m$) of each blade around its Z plane;

(c) establishing a total radius tolerance as a function of totalling the Z plane radius ($R_s$) for each slot and the radius of each blade ($R_b$) from the Z plane;

(d) for each slot, determining candidate blades which when placed in the slot fall within the total radius tolerance;

(e) starting with an extreme value of the slot Z plane radius $R_s$ dedicating a specific blade to the slot if only one blade meets the tolerance criteria, dedicating the closest out of tolerance blade producing an under tolerance radius if no blade meets the criteria, and deferring selection of a blade if a plurality of blades meets the criteria, removing said dedicated blades from the candidate blades, and continuing the dedication and removal through the remaining slots;

(f) calculating blade and disk unbalance using dedicated blades in the slots to which they are dedicated, and the extreme moment weight ($B_m$) blade of the candidate blades for the remaining slots, determining the location of the unbalance;

(g) selecting the current slot closest to the unbalance location;

(h) dedicating to said current slot the candidate blade for said slot having the extreme moment weight which tends to offset the calculated unbalance, and removing said dedicated blade from said candidate blades; and (i) repeating the steps of calculating unbalance, selecting the current slot, dedicating blades, and removing dedicated blades until blades are dedicated to all slots.

2. The method of claim 1 wherein step C comprises:

determining the difference between the smallest ($R_s$) plus the largest ($R_b$) and the largest ($R_s$) plus the smallest ($R_b$).

3. The method of claim 2 including also:

increasing the tolerance a preselected discrete amount if in step e no blade is available which is within tolerance or under tolerance; and thereafter starting the selection and dedication process anew from step d.

4. The method of claim 1 wherein:

step e comprises starting with the largest value of ($R_s$); and the step of dedicating the closest out of tolerance blade comprises selecting the longest blade of those blades too short to meet the tolerance criteria.

5. The method of claim 1 wherein step f comprises selecting the largest moment weight $B_m$ blade of the candidate blades;

step g comprises determining the location needing increased weight; and step h comprises selecting the candidate blade having the largest moment weight.

* * * * *